US008324490B1

(12) United States Patent
Walworth

(10) Patent No.: US 8,324,490 B1
(45) Date of Patent: Dec. 4, 2012

(54) CAPO PARTICULARLY SUITED TO APPALACHIAN OR MOUNTAIN DULCIMERS

(76) Inventor: Bruce Walworth, Chelsea, MI (US)

( * ) Notice: Subject to any disclaimer, the term of this patent is extended or adjusted under 35 U.S.C. 154(b) by 0 days.

(21) Appl. No.: 13/215,358

(22) Filed: Aug. 23, 2011

(51) Int. Cl.
*G10D 3/00* (2006.01)

(52) U.S. Cl. ..... 84/318

(58) Field of Classification Search ..... 84/318
See application file for complete search history.

(56) References Cited

U.S. PATENT DOCUMENTS 514,263 A * 2/1894 Filstrup ..... 84/318
5,373,770 A * 12/1994 Dudley ..... 84/318

* cited by examiner

*Primary Examiner* — David Warren
*Assistant Examiner* — Robert W Horn
(74) *Attorney, Agent, or Firm* — Gifford, Krass, Sprinkle, Anderson & Citkowski, P.C.

(57) ABSTRACT

A capo for a dulcimer or other stringed instrument comprises an L-shaped member coupled to a bar member for applying pressure to the strings. A lever pivotally coupled to the L-shaped member includes a cam surface that engages with the bar member to facilitate a first position, wherein the cam surface is disengaged from the bar member for positioning on the instrument, and a second position, wherein the cam surface is engaged with the bar member, thereby applying pressure to the opposing sidewalls of the fret board to maintain pressure applied by the bar member against the strings. An extension member may be coupled to one end of the bar member with an adjustable fastener allowing the capo to accommodate fret boards of varying width.

7 Claims, 3 Drawing Sheets

CAPO PARTICULARLY SUITED TO APPALACHIAN OR MOUNTAIN DULCIMERS

FIELD OF THE INVENTION

This invention relates generally to capos and, in particular, to a capo configured for a dulcimer.

BACKGROUND OF THE INVENTION

There are two basic types of dulcimer stringed musical instruments, the Appalachian or mountain dulcimer and the hammered dulcimer. The Appalachian dulcimer is a fretted string instrument of the zither family, typically with three or four strings. The body extends the length of the fingerboard, and its fretting is generally diatonic.

As with guitars, mandolins, and banjos, some musicians would like to use a capo on a fretted dulcimer to shorten the playable length of the strings, thereby raising the pitch. There are several dulcimer capos on the market, some of which are quick-release. One quick-release design is described in U.S. Pat. No. 5,373,770. According to this patent, the top and one side of a U-shaped body are attached together in a perpendicular orientation while the other side of the U-shaped body is in a perpendicular relationship to the top but is movable across the length of the top. The movable side of the capo is adjusted by a thumbscrew and shaft so that the overall length of the capo from side to side may be conformed to the width of the capo fret board in use by adjusting the movable side. Outside the movable end is a quick-attach lever and fastening piece. The sides of the U-shaped capo are adjusted to the width of the raised capo fret board, with the L-shaped lever pulled to the upright position. A non-concentric cam tightens the movable portion of the capo against the side of the raised fret board. Releasing the capo simply requires moving the L-shaped lever into the horizontal position, removing the side pressure of the non-concentric cam. Inside the capo are cushioned pads so that the metal dulcimer capo does not harm the wooden dulcimer fret board.

While the device just described and other designs are certainly functional, a more elegant quick-release mechanism would be welcomed by the dulcimer-playing community.

SUMMARY OF THE INVENTION

This invention resides in a capo for a dulcimer or other stringed instrument having a raised fret board with opposing first and second sidewalls and a set of strings above the fret board. The capo comprises a bent, L-shaped member having a first arm configured to face the first sidewall and a second arm configured to cross over the fret board, the second arm being configured to extend past the second sidewall of the fret board. A bar member for applying pressure to strings against the fret board has first and second ends, the first end being pivotally coupled to the first arm of the L-shaped member, with the second end extending past the second sidewall of the fret board when positioned on the instrument.

An extension member is provided having a first end coupled to the second end of the bar member and a second end configured to face the second sidewall of the fret board when positioned on the instrument. Bumpers are provided on the first arm of the bent, L-shaped member and on the second end of the extension member. A lever pivotally coupled to the second end of the bent, L-shaped member includes a cam surface configured to interact with the second end of the bar member.

The lever facilitates a first position, wherein the cam surface is disengaged from the second end of the bar member, allowing the second arm of the L-shaped member to move toward the bar member and the bumpers to move apart for placement on the instrument, and a second position, wherein the cam surface is engaged with the second end of the bar member, causing the bumpers to move toward one another, thereby applying pressure to the opposing sidewalls of the fret board to maintain pressure applied by the bar member against the strings.

The preferred embodiment further includes a sleeve of compressible, resilient material covering the bar member in the area wherein pressure is applied to the strings of the instrument. The bar member may be a cylindrical rod, in which case the sleeve may also be cylindrical. The lever may be triangular is shape, and the L-shaped member may be bent at an angle of substantially 90 degrees. The extension member is preferably coupled to the second end of the bar member with an adjustable fastener allowing the bumpers to accommodate fret boards of varying width.

DETAILED DESCRIPTION OF THE INVENTION

Figure 1:
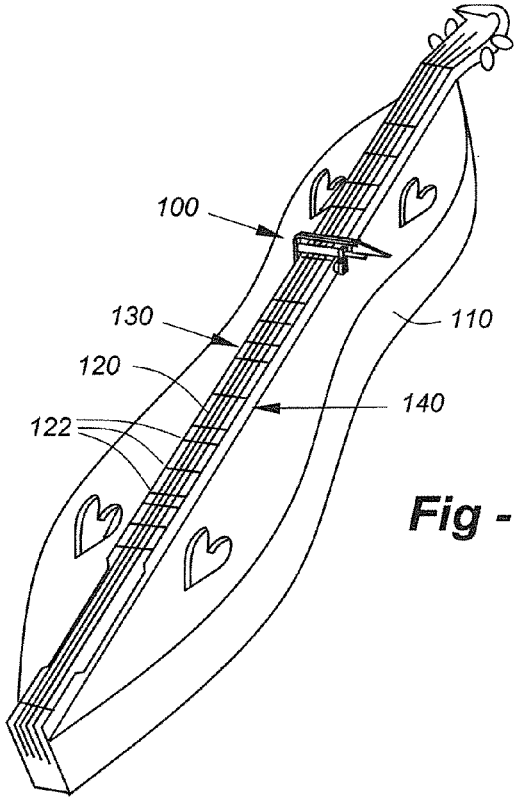
FIG. 1 is a simplified rendering of the preferred embodiment applied to a typical Appalachian or mountain dulcimer.

FIG. 1 is a simplified rendering of the preferred embodiment of a capo 100 applied to a typical Appalachian or mountain dulcimer 110 having a typically wooden fret board 120 with frets 122 and raised, opposing side walls 130, 140. The capo is ordinarily positioned transverse to the strings just past one of the frets. The capo may be applied as shown or at 180 degrees to that shown, and may be used on other instruments as-is or with appropriate modification apparent to those of skill in the art.

Figure 2:
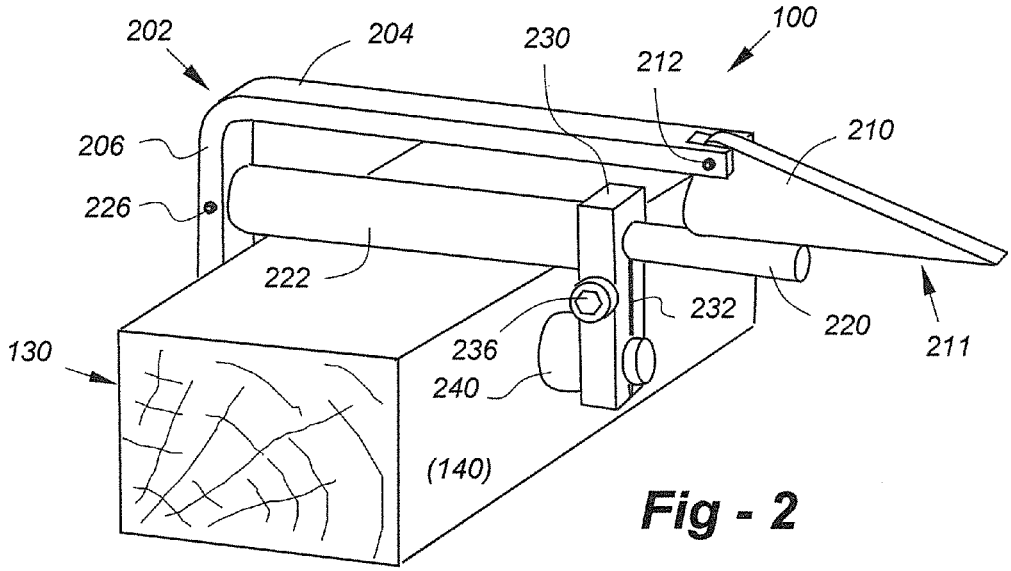
FIG. 2 is a close-up, oblique drawing of the device shown from a first perspective.
Figure 3:
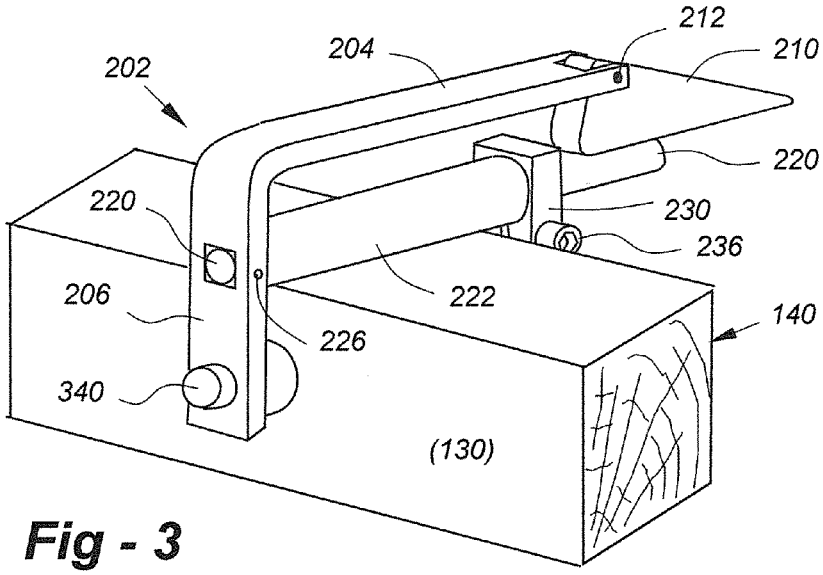
FIG. 3 is a close-up, oblique drawing of the device shown from a different perspective.

FIG. 2 is a close-up, oblique drawing of the preferred embodiment shown from a first perspective, and FIG. 3 shows the device shown from a different perspective. The device comprises a bent, L-shaped member 202 having a first arm 206 configured to face a first sidewall of a dulcimer fret board, and a second arm 204 configured to cross over and extend past the second sidewall of the fret board. A bar member 220, covered with a compressible, resilient material 222 applies pressure to strings against the fret board. The bar member 220 has first and second ends. The first end of the bar member is pivotally coupled to the first arm of the L-shaped member using a spring pin 226.

An extension member 230 has a first end coupled to the second end of the bar member and a second end configured to face the second sidewall of the fret board. The extension member 230 is coupled to the bar member 220 with a cap screw 236, allowing the bar member to be adjusted laterally on the bar member to accommodate fret boards of different widths. Tightening the cap screw 236 closes gap 232 and forms a rigid connection. Compressible, resilient bumpers 340, 240 are provided on the first arm 206 of the bent, L-shaped member and on the second end of the extension member 230.

Figure 4:
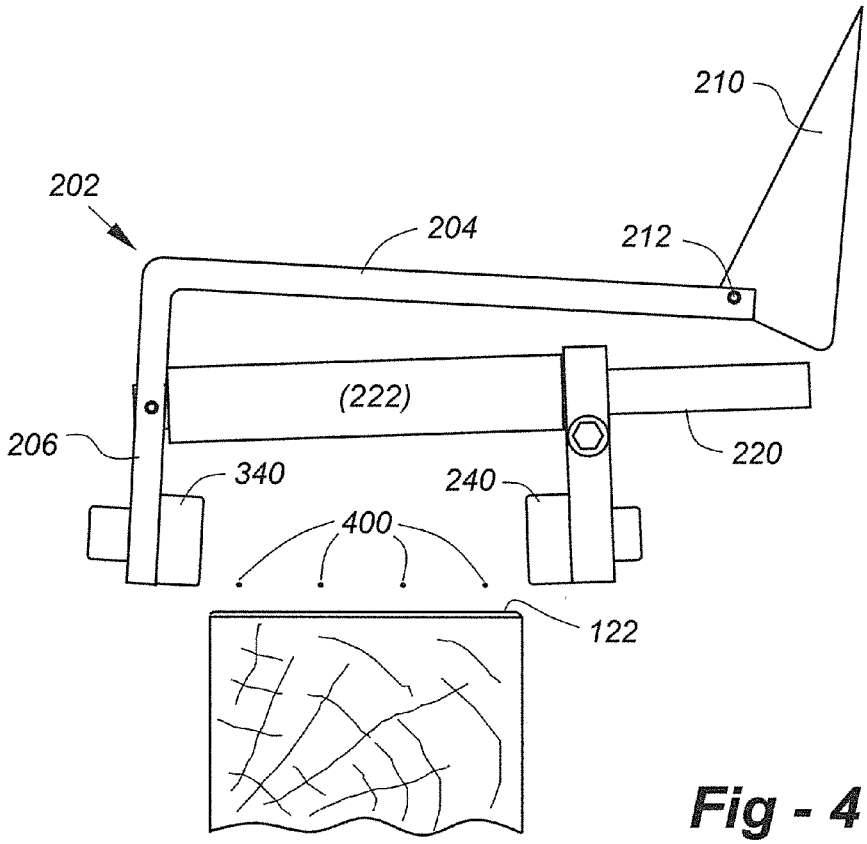
FIG. 4 illustrates the device prior to application on a dulcimer fret board.
Figure 5:
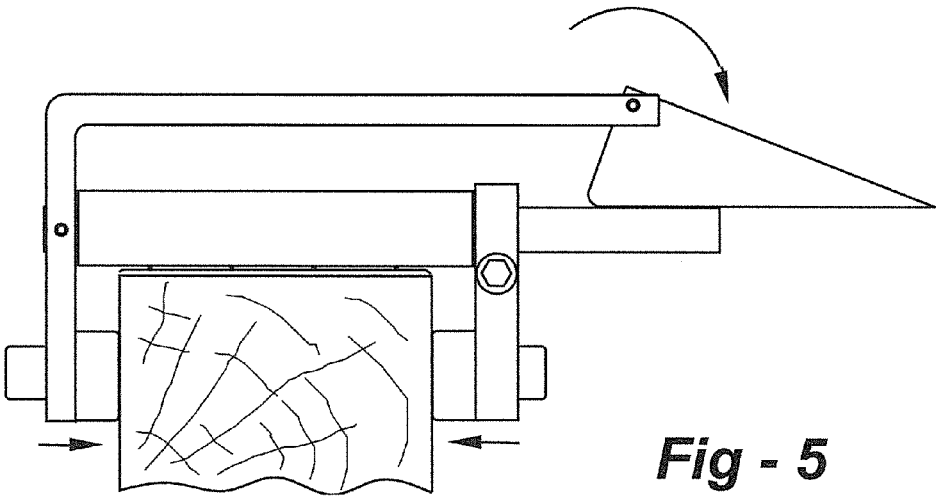
FIG. 5 illustrates the device coupled to a dulcimer fret board.

A lever 210 is pivotally coupled to the second end of the bent, L-shaped member using another spring pin 212. The 210 lever includes a cam surface 211 configured to interact with the second end of the bar member 220. The lever facilitates a first position, wherein the cam surface is disengaged from the second end of the bar member, allowing the second aim of the L-shaped member to move toward the bar member and the bumpers to move apart for placement on the instrument, and a second position, wherein the cam surface is engaged with the second end of the bar member, causing the bumpers to move toward one another, thereby applying pressure to the opposing sidewalls of the fret board to maintain pressure applied by the bar member against the strings. FIG. 4 illustrates the device in the first position prior to application on a dulcimer fret board, and FIG. 5 illustrates the device the second position, coupled to a dulcimer fret board.

Figure 6:
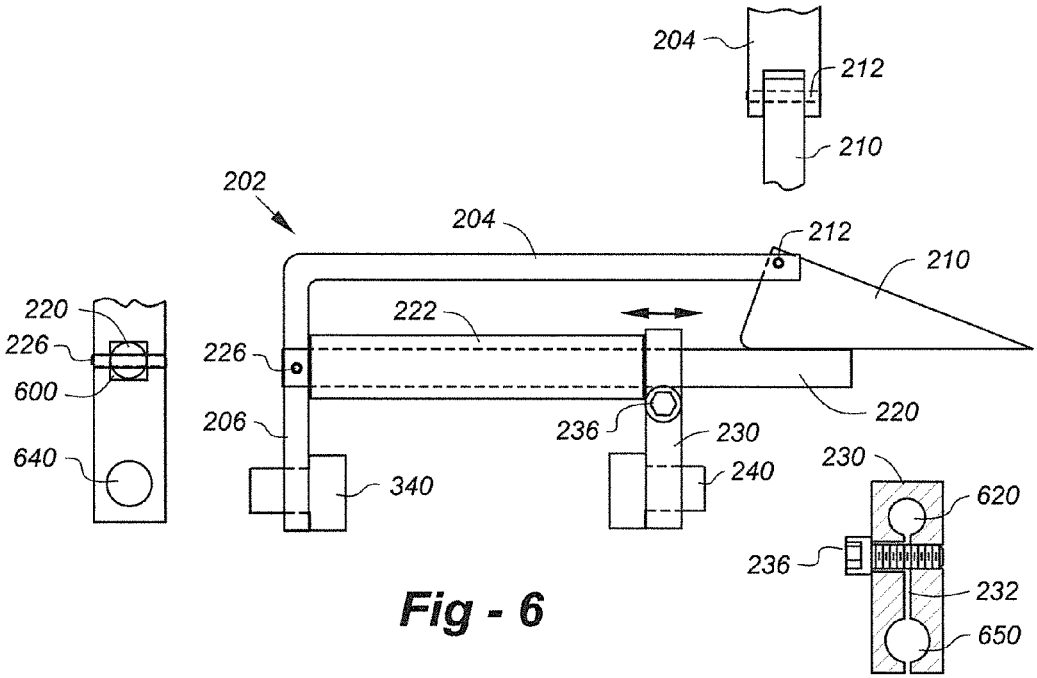
FIG. 6 is an exploded view better illustrating the component parts.

FIG. 6 is an exploded view better illustrating the component parts. While any metals or other rigid materials may be used, the larger components parts are made of brass for easy working and prolonged luster. The cap screw and spring pins may be made of steel. The lever 210 is preferably triangular in shape, and the bar member is preferably cylindrical to accept a cylindrical sleeve 222. The bar member is preferably attached to the first arm 206 of the L-shaped member 202 through a squared, broached aperture 600 to limit pivoting. The bumpers 240, 340 are made of rubber or a rubber-like material and fit into corresponding holes 650, 640.

I claim:

1. A capo for a dulcimer or other stringed instrument having a raised fret board with opposing first and second sidewalls and a set of strings above the fret board, the capo comprising:

a bent, L-shaped member having a first arm configured to face the first sidewall and a second arm configured to cross over the fret board, the second arm being configured to extend past the second sidewall of the fret board;

a bar member for applying pressure to the strings against the fret board, the bar member having first and second ends, the first end of the bar member being pivotally coupled to the first arm of the L-shaped member, the second end of the bar member extending past the second sidewall of the fret board;

an extension member having a first end coupled to the second end of the bar member and a second end configured to face the second sidewall of the fret board;

a first bumper on the first arm of the bent, L-shaped member, and a second bumper on the second end of the extension member;

a lever pivotally coupled to the second end of the bent, L-shaped member, the lever having a cam surface configured to interact with the second end of the bar member, the lever facilitating:

a first position, wherein the cam surface is disengaged from the second end of the bar member, allowing the second arm of the L-shaped member to move toward the bar member and the bumpers to move apart for placement on the instrument, and a second position, wherein the cam surface is engaged with the second end of the bar member, causing the bumpers to move toward one another, thereby applying pressure to the opposing sidewalls of the fret board to maintain pressure applied by the bar member against the strings.

2. The capo of claim 1, further including a sleeve of compressible, resilient material covering the bar member in the area wherein pressure is applied to the strings of the instrument.

3. The capo of claim 1, wherein the bar member is a cylindrical rod.

4. The capo of claim 1, wherein:

the bar member is a cylindrical rod; and the cylindrical rod is covered with a cylindrical sleeve of compressible, resilient material covering the bar member in the area wherein pressure is applied to the strings of the instrument.

5. The capo of claim 1, wherein the lever is generally triangular is shape.

6. The capo of claim 1, wherein the L-shaped member is bent at substantially 90 degrees.

7. The capo of claim 1, wherein the extension member is coupled to the second end of the bar member with an adjustable fastener allowing the bumpers to accommodate fret boards of varying width.

* * * * *